United States Patent [19]

Sbuelz

[11] 4,268,957

[45] May 26, 1981

[54] PROCESS FOR SPLICING A COAXIAL CABLE WITH A CONDUCTOR COMPOSED OF INDIVIDUALLY ENAMELED WIRE STRANDS TO A COAXIAL CONNECTOR

[75] Inventor: Anes Sbuelz, Milan, Italy

[73] Assignee: Italtel S.p.A., Milan, Italy

[21] Appl. No.: 13,230

[22] Filed: Feb. 21, 1979

[30] Foreign Application Priority Data

Feb. 21, 1978 [IT] Italy ..... 20426 A/78

[51] Int. Cl.[3] ..... H01R 43/04

[52] U.S. Cl. ..... 29/871; 156/49; 156/655

[58] Field of Search ..... 29/628, 624, 871; 174/75 C, 88 C; 156/655, 49; 134/1, 38

[56] References Cited

U.S. PATENT DOCUMENTS

| | | | |
|---|---|---|---|
| 1,653,805 | 12/1927 | Housekeeper | 134/38 X |
| 2,709,666 | 5/1955 | Speekman | 134/38 X |
| 2,968,056 | 1/1961 | Aveni | 134/38 X |
| 3,830,677 | 8/1974 | Paulin | 156/655 X |
| 3,973,227 | 8/1976 | Erculiani | 174/28 X |

FOREIGN PATENT DOCUMENTS

| | | | |
|---|---|---|---|
| 678656 | 9/1952 | United Kingdom | 156/656 |

*Primary Examiner*—Francis S. Husar
*Assistant Examiner*—C. J. Arbes
*Attorney, Agent, or Firm*—Karl F. Ross

[57] ABSTRACT

A coaxial cable of the type comprising a litz wire with individually enameled strands as an inner conductor and a wire plait as an outer conductor is spliced to a coaxial connector by exposing a top of the inner conductor and stripping part of the insulation from the outer conductor to expose a portion thereof set back from the tip of the inner conductor. Before splicing, the stripped cable extremity is immersed in a solvent for the enamel such as sulfuric acid, then subjected to ultrasonic vibration in a bath containing alcohol or fluorinated hydrocarbons, and thereafter immersed in a solution of tin. After neutralization and drying, the conductor portions so treated are joined to corresponding conductors of the coaxial connector whereupon a sleeve is placed around the joint and crimped to secure the connector to the cable.

5 Claims, 3 Drawing Figures

PROCESS FOR SPLICING A COAXIAL CABLE WITH A CONDUCTOR COMPOSED OF INDIVIDUALLY ENAMELED WIRE STRANDS TO A COAXIAL CONNECTOR

FIELD OF THE INVENTION

My present invention relates to a method of preparing a coaxial cable with a low level of cross-talk, i.e. of a kind suitable to transmit signal samples in accordance with the PAM time-division technique, for splicing same to a coaxial connector.

BACKGROUND OF THE INVENTION

Commonly owned U.S. Pat. No. 3,973,227 discloses a coaxial cable with a low level of cross-talk, which comprises an assembly of mutually insulated conductive elements each having a diameter small enough to carry, in first approximation, an electric current evenly distributed throughout each section of the element. As disclosed in the above-mentioned patent, the inner conductor of the coaxial cable may include for example a litz wire comprising a multiplicity of intertwined strands whereas the outer conductor may comprise a plurality of litz wires arranged along the generatrices of a cylinder. As is known, the individual strands forming a litz wire are enameled so as to be electrically insulated from adjacent strands. Splicing of such a cable requires, besides peeling off the outer insulating sheath and removing a portion of insulating material located between the inner conductor and the outer conductor, a removal of the enamel from the portion of the wire strands designed to contact elements of the connector to establish good electrical contact conductive between the cable and the connector.

Removal of enamel from a portion of litz wire is usually effected by immersing the portion in question in molten tin at a temperature higher than the sublimation temperature of the enamel (≈400° C.).

However, cleaning of a coaxial cable of the above-mentioned type cannot be effected by immersion in molten tin since, owing to the high temperature at which this operation takes place, the insulating material located between the inner conductor and the outer sheath would be damaged, which would have a detrimental effect on the electrical characteristics of the cable. Moreover, in a damaged portion of cable cross-talk phenomena would occur.

The use of pickling liquids available on the market does not provide a satisfactory solution to the aforementioned problem where the cable to be spliced is of the kind having a multistrand outer conductor in the form of a plait preventing the liquid from penetrating and impeding removal of the enamel from the strands of the inner conductor. Thus, when a cable of this type is cleaned by means of pickling liquids prior to splicing, the electrical characteristics of the resulting joint are unsatisfactory.

OBJECT OF THE INVENTION The object of my present invention is to provide an improved process for splicing a cable of the aforedescribed type designed to obviate the problems heretofore encountered in the baring of individually enameled wire strands.

SUMMARY OF THE INVENTION

In accordance with my present invention, a coaxial cable of this type—having an inner and/or an outer conductor composed of individually enameled wire strands and a multistrand outer conductor as well as intervening and surrounding layers of insulation is spliced to a coaxial connector by a process which comprises the following steps:

I. stripping away parts of the intervening and surrounding layers of insulation on an extremity of the cable to expose a tip of the inner conductor and a portion of the outer conductor set back from that tip;

II. immersing the stripped cable extremity in a solvent for the enamel;

III. removing the dissolved enamel by subjecting the cable extremity to ultrasonic vibration in a bath;

IV. immersing the cable extremity in a chemical tin-plating solution; and

V. thereafter joining the tip of the inner conductor and a portion of the outer conductor to corresponding conductors of the associated connector.

BRIEF DESCRIPTION OF THE DRAWING

The above and other features of my invention will now be described in detail with reference to the accompanying drawing in which.

SPECIFIC DESCRIPTION

Figure 1:
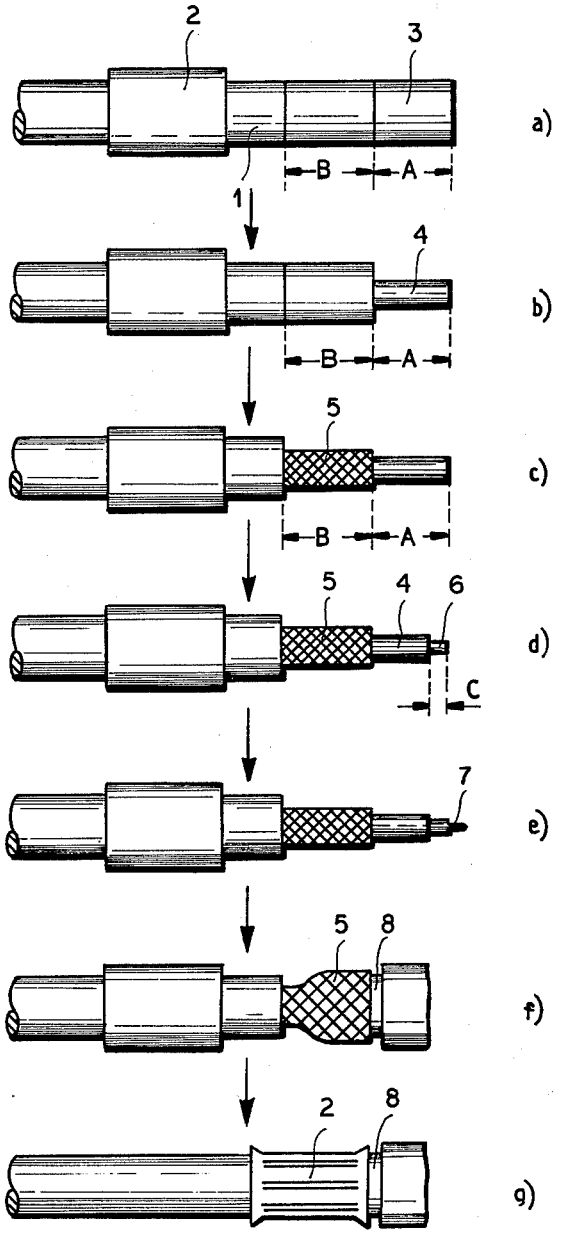
FIG. 1 is a flow diagram showing a sequence of steps of my improved cable-splicing process.

Reference will first be made to FIG. 1 showing a series of cable-splicing steps a through g.

The step a comprises inserting extremity of the cable 1 to be spliced into a crimping cylinder 2 and forming a first circular cut at a distance A from the end and a second cut at a distance B from the first cut.

The step b comprises removing a length A of an outer insulating layer 3 together with a similar length of an underlying plaited conducting sheath 5 to uncover an inner insulating layer 4.

The step c comprises removing a length B of outer insulating layer 3 to uncover an additional portion of sheath 5 forming the outer conductor of the cable.

The step d comprises removing a small portion C of inner insulating layer 3 to uncover a tip of the inner conductor 6.

The step e comprises splicing the inner conductor 6 to the central conductor element of a coaxial connector 7 by welding or crimping.

The step f comprises inserting the end of the outer conductor element 8 of the connector 7 into the sheath 5.

The step g comprises sliding the crimping cylinder 2 over the sheath 5 and crimping the cylinder.

Figure 2:
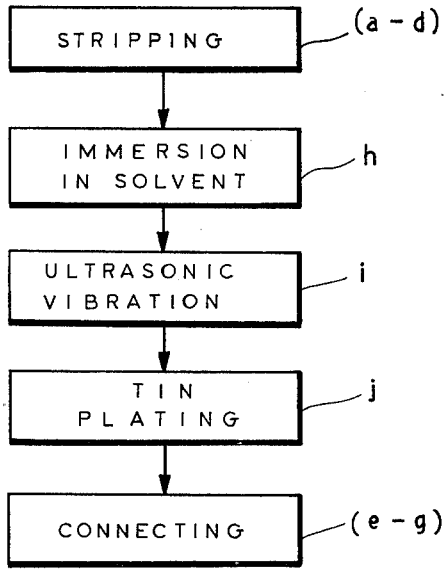
FIG. 2 is a block diagram showing additional steps.

Splicing of a stranded cable of the above-discussed type requires a sequence of additional operations between the steps d and e described above, comprising in combination the following characteristic steps shown in FIG. 2. The illustrated end of the cable, stripped in accordance with steps a–d, is immersed over a length A+B (step f) in a chemical agent capable of dissolving the enamel coating of the wire strands forming the inner conductor 6. I have found that a particularly suitable chemical agent for etching the enamel is sulfuric acid.

I also prefer to carry out several immersions in concentrated solutions at various temperatures to obtain effective etching action.

The next-following step i comprises removing the enamel dissolved in this manner by immersing the same cable length A+B in a bath subjected to ultrasonic vibration.

I have found that the kind of bath giving the best results contains solutions of certain cleaning adjuvants such as fluorinated hydrocarbons (Freon) or alcohol.

The last step j of this sequence comprises immersing the stripped cable extremity, which has been cleaned by means of the two previous steps, in a chemical plating solution of tin which is deposited on the conductors and ensures good electrical contact with the elements of the connector while also preventing the copper wires from becoming oxidized, thereby ensuring long-lasting electrical performance.

The above-described sequence of operations is completed by two additional steps aiming at protecting the cable against alterations in its characteristics obtained at the end of the sequence.

After immersion in the ultrasonically excited bath, traces of acid remain on the cable which could attack its conductor strands. I therefore prefer to add a neutralization, step which comprises immersing the cable in a basic solution to eliminate the traces of acid, followed by a drying step.

Figure 3:
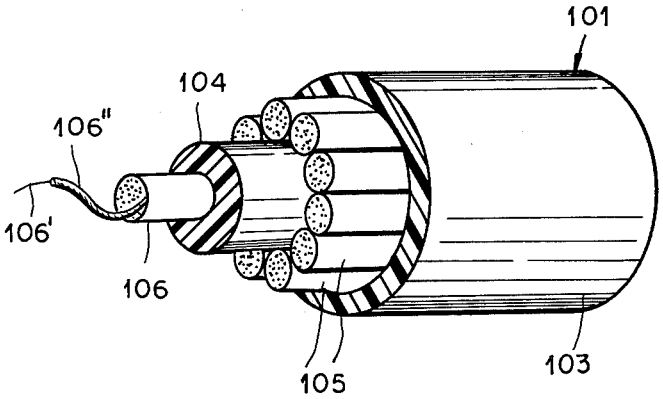
FIG. 3 is a perspective view of a coaxial cable differing somewhat from the cable of FIG. 1.

FIG. 3 illustrates a cable 101 as shown in prior U.S. Pat. No. 3,973,227 in which both the outer and the inner conductor, here designated 105 and 106, are in the form of litz wires and are separated by a first insulation 104, the outer conductor 105 being surrounded by a second such layer 103. One of the strands of inner conductor 106, shown at 106', is seen to be provided with an enamel coating 106".

The process described above with reference to FIGS. 1 and 2 is also applicable to the modified cable 101, with insulation layers 103, 104 and litz wires 105, 106 respectively replacing the layers 3, 4 and conductors 5, 6 of FIG. 1

I claim:

1. A process for splicing a coaxial cable to a coaxial connector, said cable having an inner and an outer conductor at least one of which is composed of individually enameled wire strands, a first layer of insulation separating said conductors, and a second layer of insulation surrounding said outer conductor, comprising the steps of:

(I) stripping away parts of said first and second layers to expose a tip of said inner conductor and a portion of said outer conductor, set back from said tip, on a cable extremity to be spliced;

(II) immersing said cable extremity in a solvent for the enamel covering said wire strands;

(III) removing the dissolved enamel by subjecting said cable extremity to ultrasonic vibration in a bath;

(IV) immersing said extremity in a chemical tin-plating solution; and (V) thereafter joining said tip of said inner conductor and said portion of said outer conductor to corresponding conductors of said connector.

2. A process as defined in claim 1 wherein said solvent is sulfuric acid.

3. A process as defined in claim 1 wherein said bath contains a fluorinated hydrocarbon.

4. A process as defined in claim 1, 2 or 3 comprising, after step (III), the further steps of immersing said cable extremity in a basic neutralizing solution and then drying said cable extremity.

5. A process as defined in claim 1 wherein said bath contains an alcohol.

* * * * *